United States Patent [19]

Barnett

[11] 4,173,338

[45] Nov. 6, 1979

[54] GAME SCORE APPARATUS

[76] Inventor: Robert L. Barnett, 4918 N. Deception Loop, Oak Harbor, Wash. 98277

[21] Appl. No.: 841,342

[22] Filed: Oct. 12, 1977

[51] Int. Cl.[2] ..... A63F 7/06

[52] U.S. Cl. ..... 273/85 B; 273/85 R; 273/DIG. 26

[58] Field of Search ..... 273/85 B, 85 R, 85 C, 273/85 D, 85 G, 85 F, 85 A, 85 E, 85 H, 118 A, 119 A, DIG. 26

[56] References Cited

U.S. PATENT DOCUMENTS

| | | | |
|---|---|---|---|
| 2,085,849 | 7/1937 | Dollison et al. | 273/1.5 R |
| 2,999,233 | 9/1961 | Dresbach et al. | 273/1.5 R X |
| 3,907,293 | 9/1975 | Werner | 273/85 A |

FOREIGN PATENT DOCUMENTS

| | | | |
|---|---|---|---|
| 665860 | 7/1963 | Canada | 273/85 B |
| 505467 | 12/1954 | Italy | 273/85 D |

OTHER PUBLICATIONS

"World of Sports", by Coleco Mar. 1970.

*Primary Examiner*—George J. Marlo
*Attorney, Agent, or Firm*—Robert D. Farkas

[57] ABSTRACT

A game score apparatus utilizes a display apparatus in conjunction with a miniaturized hockey game which responds to the output signal generated by placing the puck in a holding position from which it is dispensed automatically so as to simultaneously start up a display clock exhibited on a display panel in digital form. The clock continues to operate until such time that the puck is disposed in one of the two goal positions so as to descend downwardly into a transparent tube causing a photoelectric cell to sense its presence therein. Scoring automatically takes place at the same time as the clock is then stopped. Apparatus is provided for adding additional score points to either of the two displayed scores, similarly displayed in digital form. A counter is utilized to determine which game period is in progress. Such counter being operated by the timing apparatus reaching the total period equivalent to a full period play.

9 Claims, 5 Drawing Figures

GAME SCORE APPARATUS

BACKGROUND OF THE INVENTION

1. The Field of the Invention

This invention relates to games devices and more particularly to that class of apparatus having the electronic read out displays key to the functional components of play.

2. Description of the Prior Art

The prior art abounds with game devices suitable for use with miniaturized versions of various athletic games. U.S. Pat. No. 3,881,726 issued on May 6, 1975 to G. Serafini discloses a miniature game of table soccer. The table top has a miniature soccer playing field thereon on which a plurality of figurine soccer players are moved into playing positions in respective zones. The figurines are mounted on end portions of respective metal tapes that can be individually advanced longitudinally and retracted and are individually transported transversely of the playing field. Manually actuated actuators advance and retract the tapes and move them transversely of the playing field zones for transporting the figurine soccer players individually into repective playing positions for kicking or throwing a playing ball. Goals and goalkeeper soccer players are actuated individually likewise by respective tapes.

U.S. Pat. No. 3,907,293 issued on Sept. 23, 1975 to W. M. Werner describes a game comprising a playing board and two opposing U-shaped ball driving members located adjacent opposite ends of the board and moveable thereover in different directions to propel a ball over the board and toward goals located adjacent the opposite ends of the board. Swinging paddles simulating hockey players or the like are connected to the driving members in such a manner that movement of the drive members in certain directions actuate certain of the paddles and movement of the driving members in other directions actuate certain others of the paddles.

U.S. Pat. No. 3,920,243 issued on Nov. 18, 1975 to A. Santos, Sr. teaches a soccer game which employs a substantially planer playing surface within which are formed a plurality of spaced apart recesses. A goal section is located at each longitudinal end of the playing surface and each goal section is protected by a playing member which is moveable thereacross. A spherical playing object is adapted to be locatable upon the playing surface. Each recess is constructed so that the playing object is caused to be positioned at the lowest part of each recess. The lowest part of each recess is located just forward of a playing member which is locatable within each said recess. The playing member is movable between a retracted position and an extended position to cause propelling of the playing object. The playing members are selectively actuatable by means of an actuating means connected at each end of the playing surface.

All of the aforementioned apparatuses utilize a playing field which is played on in nature having movable playing members, simular to the concept used in conjunction with the present invention. However, none of such patents teach an apparatus useful in scoring the achieved object of the game when any player manages to propel the ball or puck into the desired goal area. Such apparatus is left to the will of the players whose attention is usually preferably directed toward playing the game, rather than maintaining a score. Timing problems, frequently used in the actual full-sized version of playing the game, is similarly left to the imagination of the players, or at best is inaccurately attended to.

SUMMARY OF THE INVENTION

A primary object of the present invention is to provide a game apparatus scoring device suitable for operation with a miniature game apparatus so as to accurately maintain scores and time and their interrelationship.

Another object of the present invention is to provide an apparatus which automatically displays the score achieved by a "team."

Still another object of the present invention is to provide an apparatus which maintains the playing piece in a stored position until ready for use, thence disposing same and simultaneously starting up, or restarting up, the time display, thus providing an accurate interrelationship between the time of ball play and the total time elapsed for such ball play without requiring a third "participant" individual acting as a scorekeeper. Conventional circuitry, such as solid-state devices and alpha-numeric readout are utilized to provide the information relating to the scoring at both ends of the miniature playing field and the time elapsed during any playing period as well as the actual playing period currently in progress.

These objects as well as other objects of the present invention, will become more readily apparent after reading the following description of the accompanying drawings.

DESCRIPTION OF THE PREFERRED EMBODIMENT

Figure 1:
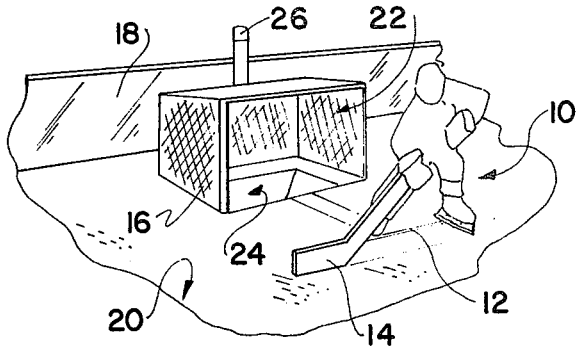
FIG. 1 is a perspective view of a goal apparatus utilized in the same scoring apparatus herein.

The structure and method of fabrication of the present invention utilizes a large rectangular rigid sheet, such as fabricated from wood or plastic, preferably having the dimensions of 4 feet by 8 feet and a suitable thickness. Both ends of the sheet contain rectangular openings having a net structured disposed therearound, including an open-mouthed portion directed towards the remainder of the sheet. Disposed located beneath each opening is a transparent shoot connecting the opening to a dispensing opening such that pucks dropped thereinto pass through the transparent passageway so as to communicate optically with a light source and a photoelectric beam. When a goal is scored, the puck operates a photoelectric receiver, of any conventional variety, so as to signal the apparatus in an appropriate fashion. Also associated with the apparatus is a puck retainer and dispenser. This comprises a hollow tube supported above the surface of play by a truss. The puck is inserted into the upper opening of the tube, coming to contact with the plunger of a solenoid coil operated apparatus. When residing in the stored position, the puck engages an operating arm of a switch. At the appropriate time, the puck is released by having the coil of the solenoid coil retract within the coil allowing the puck to descend onto the playing field. The switch mechanism then signals that the puck is no longer stored within the passageway.

The apparatus includes a display board having thereon a running clock, operating only when the clock has not reached a total time equivalent to a period of play and only when the play is interrupted by the puck entering one of the goal openings, commencing thereafter in operation when the puck is stored into the dispensing apparatus and dropped onto the board for play. Thus, the display apparatus is initiated into running by the puck leaving the dispensing apparatus and entering the board. As long as the puck is on the board the clock continues to run. When a puck enters a goal opening the clock ceases operation until such time that the puck is retrieved by one of the players and placed into the dispensing apparatus. A timer facilitates allowing the player storing the puck in the dispensing apparatus to assume a playing position. At the end of the preset interval, the puck is dispensed onto the playing surface and the clock continues to run until such time that the play period ends or another goal is scored. On the scoring, the same photoelectric cell triggers a latching circuit which causes the time clock to cease running. When the puck is stored in the dispensing apparatus the sensing switch associated therewith initiates a timer into operation allowing the puck to be dispensed downwardly onto the playing field surface. A manual reset switch is utilized to readout time displayed by the digital alpha-numeric display apparatus associated with the time clock. Each time the time clock successfully reaches a total period of time concluding to a play period, a counter is activated operating a light, indicating a time period in progress. When the photoelectric cell is operated by the puck, it additionally signals a counter, individually associated therewith, utilized to operate a score display, calibrated in numerical indicia. Manual operating switches are provided to operate the counter as well so as to permit the players to adjust the score in accordance with the game rules.

Now referring to the figures, and more particularly to the embodiment illustrated in FIG. 1 showing a player 10, shown attached to lever 12, which moves to manipulate miniature player 10 and hockey stick 14 to the area of goal 16. Backboard 18 prevents a puck, not shown, from emerging outwardly from the playing surface 20 utilized in carrying the puck then in play. Open-mouthed portion 22 of goal 16, is transverse to opening 24 located in surface 20. Light 26, is made operative by an apparatus, not shown, each time a puck, not shown, is permitted to pass downwardly to opening 24.

Figure 2:
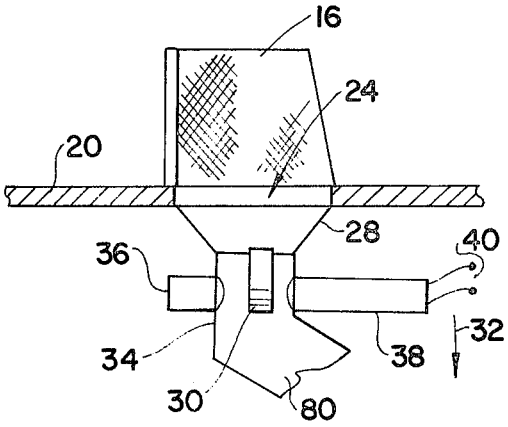
FIG. 2 is a side elevation, cross sectional view of a goal and a portion of the playing board.

FIG. 2 illustrates goal 16 disposed on surface 20. Opening 24 is shown communicating to duct portion 28. Puck 30 is shown inflight descending downwardly in the direction of arrow 32 contained within transparent tube 34. Light source 36 emits light directed towards photoelectric receiver 38. Such receiver may be of any conventional well known type, including photosensitive diodes. Puck 30 is shown interposed between light source 36 and photoelectric cell 38, thereby causing cell 38 to change its electrical properties for that instant that puck 30 in so positioned. The output of photoelectric cell 38 emerges from terminal 40.

Figure 3:
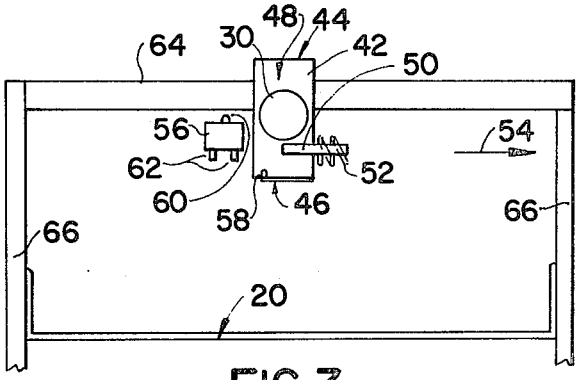
FIG. 3 is a puck retainer and disposing apparatus, utilized in the present invention.

FIG. 3 illustrates the dispenser 42 having open-mouthed portion 44 disposed at one end thereof and another open-mouthed puck dispensing portion 46 located in the lower most region thereof. Puck 30 is shown now located within passageway 48 and supported by rod 50 positioned therebelow. Coil 52, when electrically energized, causes rod 50 to move in the direction of arrow 54 so as to permit puck 30 to move downwardly in the direction of arrow 32, as shown in FIG. 2. Switch 56 is carried by tube 42 and is provided with operating lever 58 shown disposed beneath puck 30 and engaged therewith when puck 30 is stored within tube 42. Push button 60, of switch 56 is depressed downwardly as operating lever 58 is caused to be lowered due to the weight of puck 30. Terminal 62, of switch 56, signals the electrical circuitry of the present invention that puck 30 is stored within tube 42. The tube is carried by bar 64 and supported by post 66 such that bar 64 is disposed above playing surface 20 at a convenient location on the playing field, not shown.

Figure 4:
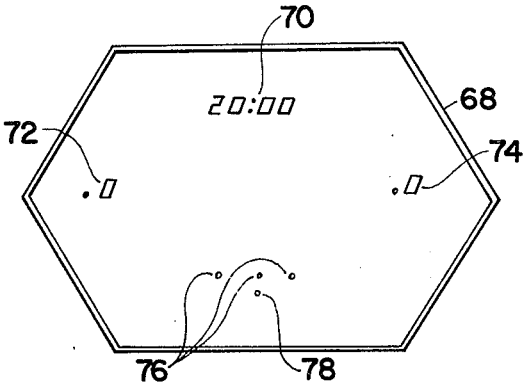
FIG. 4 is a score board display utilized in the present invention.

FIG. 4 illustrates score board 68 having indicia 70 illustrated displaying a time period in minutes and seconds. Indicia 72 is utilized to display the score for one of the two "teams" utilized in the associated apparatus. In similar fashion indicia 74 displays the score achieved by the other "team" utilized herein. Indicia 76 displays the game period in progress, utilizing lights therefore disposed in a horizontal row. Light 78, illuminates when the game is over at the conclusion of the last period, each period being indicated by lights or lamps 76.

Figure 5:
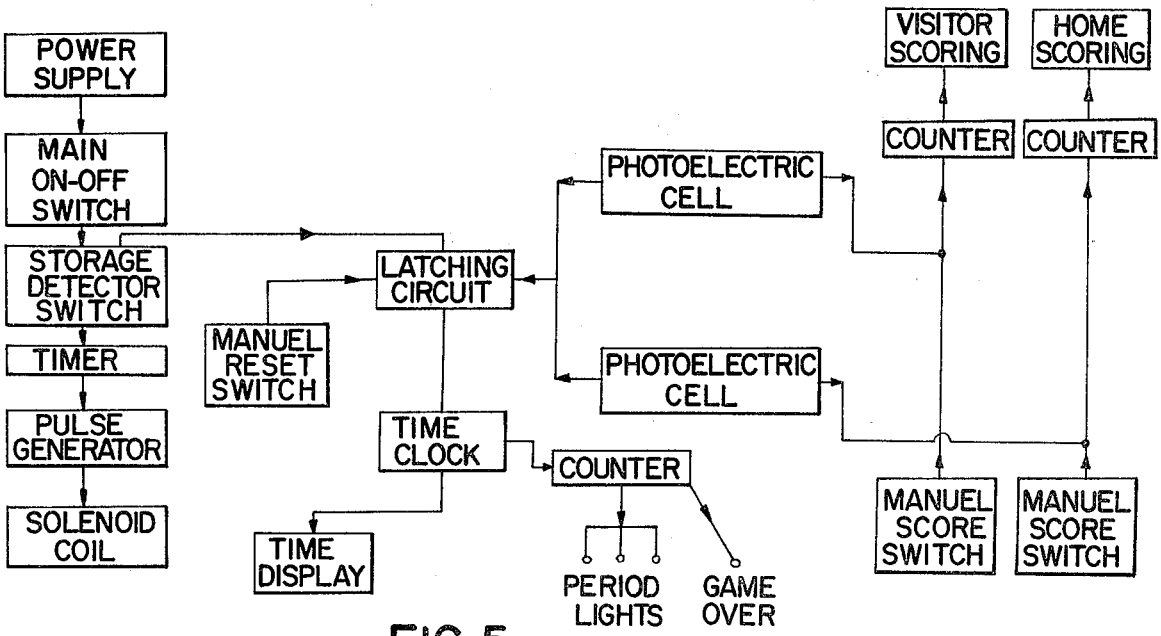
FIG. 5 is a block diagram of active components of the present invention.

FIG. 5 shows a block diagrammatic representation of the apparatus required to operate the components of the devices in FIGS. 2, 3 and 4. Power supply means are provided, either in the form of a battery or in the form of a rectified alternating current, such kind being proivded by a household utility outlet. Main on-off switch disengages the balance of the electronic circuitry from the power supply or engages same. Such switch is disposed secure to a portion of the playing field at a convenient location. Stage detection switch is shown coupled to the main on-off switch such that when it is closed, power is provided to a 10 or 20 second timer, causing such timer to measure the elasped time period from placing the puck in dispensing tube 42, shown in FIG. 3, until such time that the solenoid coil is energized at the conclusion of the time period. Such timer may be of the conventional R-C variety or may be of digitalized form such that when the elapsed time period is over, a pulse of energy, provided by the pulse generator shown, initiates a solenoid coil for a short period of time. Such pulse generator, may comply a differentiator, well known in the art. A latching circuit is shown operated by the storage detector switch such that when puck 30, shown in FIG. 3, is disposed within tube 42, a latching circuit is engaged and made operable thereafter. When the puck engages either opening 24 and passes before photoelectric cell 38, located in either goal region, as shown in FIG. 2, either photoelectric cell shown is made operable unlatching the latching circuit. Simultaneous with either photoelectric cell being deactivated by the lack of light emerging outwardly from light source 36, shown in FIG. 2, either counter, two in number, feeding a visitor scoring display is made operable by registering an additional count of one. Such score display comprise a numeric display, well known in the art, and are usually of the binary variety. Manually operated scoring switches, momentary in nature, are provided, each operating the individual counter which in turn controls the visitor or the home score display. Thus, operation of one of the manual score switches causes the associated counter to count up one and to cause the score display on the associated display to register the next highest digit. A manual reset switch is provided, which disengages the latching circuit, in similar fashion as the photoelectric cells so as to permit the electronic time clock, well known in the art, to become inoperable this permiting the players to negotiate a halt in play without having the displayed running time indicators continue to operate. A numerical time display, signified by indicia 70, shown in FIG. 4, provides a visual readout of time. The time clock feeds a counter a signal, in conventional fashion, such that such signal exists only at the end of a predetermined time period, say 10 minutes. The counter in turn feeds three period lights such that each light lights up successively permiting the players of the game to remember which period is taking place. A "game over" light is provided, operated by the same counter at the conclusion of the last play period indicated by the third period light. When the main on-off switch is thrown to the off position, this now opens contacts disengages each of the remaining electronic devices utilized in the display apparatus. It is at this time, that all counter automatically are reset to a zero count and the time clock automatically resets back to zero time. Thus, when it is decided to terminate a game prematurely, or to start another game because of the conclusion of the current game, all that is required to be done is to manipulate a main on-off switch through the off position. This is accomplished by utilizing circuitry, well known in the art, which relies on temporaty stored memory as opposed to a predetermined and invariably fixed memory apparatus. The shift register lines of such devices are biased back so as to register zero on the appropriate output terminal when power is reinstalled feeding these apparatuses. The time clock is provided with a selector switch, not shown, which enables the time for each playing period to be selected from a 10 minute maximum to say a 20 minute maximum. Similarly, the timer is permited to be operated over a range of times so as to allow the players to resume a playing position in the period between the dropping of the puck, not shown, into tube 42, shown in FIG. 3, until the time the puck 30 descends to playing surface 20. The players, not shown, are passing through rigid rods, preferably fabricated from steel which extends along the length of the table, and which may be played in or out so as to control the direction of the miniature players associated therewith. Each of the miniature players are pivotably secured to these rods so that when the rods are turned the players are caused to spin around at 4 times the rate at which the rods are rotated. Similarly, a "goalkeeper" is controlled by a rod disposed at each end of the table. The game may be played by 2 or 4 people at one time by virtue of the enlarged size of the board and by utiizing the game scoring apparatus, disposed secured to one elongated marginal edge of the board, easily accessible to all the players of the apparatus. Light 26, shown in FIG. 1, is caused to operate when the associated photoelectric cell is deenergized by virtue of puck 30, shown in FIG. 2, passing therebefore. This serves to clearly announce that the puck has dropped into a specific goal area when not in sight. Passageway 80, shown in FIG. 2, is communicated to another passageway 80, not shown, so as to dispense puck 30 to a dispensing point located adjacent a marginal edge of the playing board.

One of the advantages of the present invention is a game apparatus scoring device suitable for operation with a miniature game apparatus so as to accurately maintain scores and time and their interrelationship.

Another advantage of the present invention is to provide an apparatus which automatically displays the score achieved by a "team."

Still another advantage of the present invention is to provide an apparatus which maintains the playing piece in a stored position until ready for use, thence disposing same and simultaneously starting up, or restarting up, the time display, thus providing an accurate interrelationship between the time of ball play and the total time elapsed for such ball play without requiring a third "participant" individual acting as a scorekeeper. Conventional circuitry, such as solid-state devices and alpha-numeric readout are utilized to provide the information relating to the scoring at both ends of the miniature playing field and the time elapsed during any playing period as well as the actual playing period currently in progress.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not by the specific disclosure herein, but only by the appending claims.

The embodiment of the invention in which an exclusive privilege or property is claimed are defined as follows.

I claim:

1. In the combination of a miniature hockey game apparatus having miniature hockey like playing figures disposed over a playing surface and a goal area, such playing figures being manually moveable, a puck for engagement with a hockey stick carried by said figures, the improvement comprising said board having an opening therein, said opening being disposed adjacent said board, means to detect the dropping of said puck through said opening, means to store said puck over said playing surface, means to detect the presence of said puck in said position over said playing surface, means to dispense said puck onto said playing surface after the expiration of a time interval following the placement of said puck in said position over said surface, a time indicating display, means to enable the operation of said time display when said puck descends downwardly towards said playing surface, means to disable said time display when said puck passes through said opening.

2. The apparatus as claimed in claim 1 further comprising scoring displays for at least displaying a numerical count for each time that said puck passes through said opening.

3. The apparatus as claimed in claim 2 further comprising manual scoring means for increasing a numerical count displayed by said scoring display upon the manual operation thereof.

4. The apparatus as claimed in claim 1 further comprising a time period indicating lamp, said time period indicating lamp electrically coupled to a counter, said counter electrically coupled to said time display, said period indicating lamp energizing upon the conclusion of a predetermined time period following the display thereof on said time display.

5. The apparatus as claimed in claim 1 further comprising a hollow tube, a rod engaged within the passageway of said tube, a solenoid coil disposed wrapped about a portion of said rod, said rod being pulled outwardly from said passageway upon the energization of said coil.

6. The apparatus as claimed in claim 5 further comprising a switch, said switch having an operating lever, a portion of said operating lever being disposed within said passageway.

7. The apparatus as claimed in claim 1 further comprising a duct, said duct communicating to said opening and located therebelow, a light source, a photoelectric cell, said light source being located on one side of said duct opposite the location of said photoelectric cell, said duct being transparent.

8. The apparatus as claimed in claim 1 further comprising a score board, said score board having a time display utilizing alpha-numerical indicia therefore, said score board having at least a pair of numerical displays, said at least a pair of numerical displays individually displaying numerals.

9. The apparatus as claimed in claim 1 wherein said time interval is pre-set.

* * * * *